United States Patent [19]

Goldschild

[11] Patent Number: 4,915,178

[45] Date of Patent: Apr. 10, 1990

[54] METHOD OF INSERTING A TOOL INTO A WELL UNDER PRESSURE

[75] Inventor: Pierre Goldschild, Vulaines sur Seine, France

[73] Assignee: Schlumberger Technology Corporation, Houston, Tex.

[21] Appl. No.: 351,514

[22] Filed: May 12, 1989

[30] Foreign Application Priority Data

May 19, 1988 [FR] France ..... 88 06686

[51] Int. Cl.[4] ..... E21B 33/072

[52] U.S. Cl. ..... 166/385; 166/70; 166/77

[58] Field of Search ..... 166/385, 70, 77, 338, 166/339, 379, 381

[56] References Cited

U.S. PATENT DOCUMENTS

| | | | |
|---|---|---|---|
| 2,210,359 | 8/1940 | Boulter | 166/70 |
| 2,810,439 | 10/1957 | McCullough et al. | 166/385 X |
| 3,500,907 | 3/1970 | Gentry | 166/70 |
| 3,556,209 | 1/1971 | Reistle, III et al. | 166/70 |
| 3,637,009 | 1/1972 | James | 166/77 X |
| 4,307,783 | 12/1981 | Lanmow, II | 166/385 X |
| 4,331,203 | 5/1982 | Kiefer | 166/339 |
| 4,681,168 | 7/1987 | Kisling, III | 166/70 X |
| 4,825,953 | 5/1989 | Wong et al. | 166/338 |

*Primary Examiner*—Hoang C. Dang

*Attorney, Agent, or Firm*—Henry N. Garrana; John H. Bouchard

[57] ABSTRACT

The method comprises inserting each of the sections of a tool in turn into a well under pressure via a pressure lock and using a first cable of small diameter in order to overcome the pressure in the well head, and then replacing the first cable by a second cable of larger diameter once the weight of the sections which have been inserted into the well exceeds a predetermined value which is a function of the diameter of said second cable.

8 Claims, 4 Drawing Sheets

METHOD OF INSERTING A TOOL INTO A WELL UNDER PRESSURE

Figure 1A:
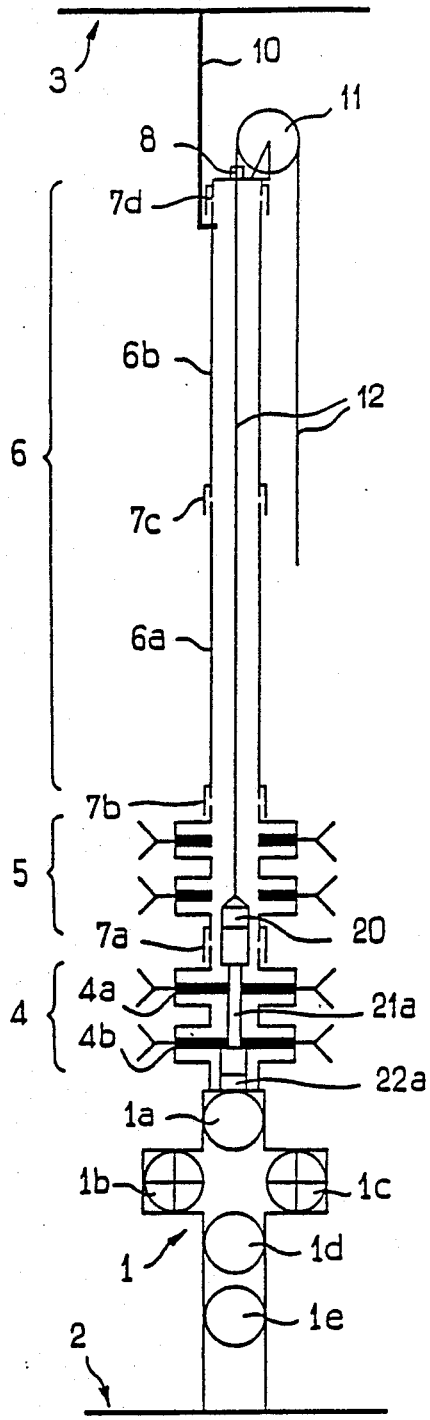

The invention relates to operations which are conducted inside a well under pressure, e.g. an oil well or a gas well, and it relates more particularly to a method of inserting a tool into such a well.

Producing wells very often present a high well head pressure, which may reach several hundred bars in the case of a gas well. In order to be able to conduct operations inside such a well, it is necessary to install a pressure control equipment onto the well acting as a pressure lock enabling a tool suspended at the end of a cable to be inserted into the well.

In the present application, the term "tool" means any device for insertion into a well; in particular it covers tools used in production logging, perforating devices, the devices used for operating bottom valves, etc. .... In general, the tool is in the form of an elongate body comprising a plurality of sections assembled end-to-end. The tool is suspended from the end of the cable by means of a cable head. By way of numerical illustration, the tool may be more than 20 meters long and its diameter is generally about 50 mm.

It will readily be understood that it is desirable, for simplicity reasons, to use a pressure lock whose height is greater than the length of the tool which is to be inserted into the well.

However, it is not always possible to assemble a pressure lock to the desired height, the height of the pressure lock being limited by some obstacle disposed vertically above the well head, e.g. the top deck of an offshore platform, or it may be limited by the height of the crane jib which supports the pressure lock for a well which is on land.

U.S. Pat. NO. 4,681,168 provides a solution to this problem; it proposes inserting the tool into the well in successive sections. To this end, it provides for inserting:

firstly a cylindrical coupling for interconnecting two successive sections of the tool; and secondly a blow-out preventor (BOP) between the well head and the pressure lock, with the BOP having jaws that engage the outside surface of the cylindrical coupling hermetically.

The method comprises inserting each of the sections together with a cylindrical coupling at its top end one-by-one into the well via the pressure control equipment. It may be summarized as follows:

the first section of the tool is inserted into the well until the coupling at the top end of the section faces the jaws of the BOP;

the jaws of the BOP are closed hermetically around the cylindrical coupling so as to isolate the pressure lock from the well; and the pressure lock is decompressed, emptied, and opened to atmospheric pressure.

It is then possible to detach the cable head from the cylindrical coupling and thus repeat the above steps as many times as may be necessary to insert the entire tool into the well.

However, this method provides only a partial solution to the problem of inserting a tool into a well under pressure, since it does not provide a solution for the case where the well presents high pressure at the well head. Reducing the available length of pressure lock while still providing the ballast necessary for overcoming the pressure constitutes a real problem. Although a substantial gain of weight can be obtained by using tungsten ballast bars, this is not always sufficient for a well presenting high pressure at its well head.

The invention therefore seeks to make it possible to insert a tool suspended from the end of a cable into a well which is under pressure.

According to the invention, the method of inserting a tool into a well under pressure, with the tool being suspended from the end of a cable and comprising a plurality of sections interconnected end-to-end by cylindrical couplings, comprises inserting each of said sections into the well in turn, with each of said sections being previously provided at its top end with a cylindrical coupling and with each section being inserted into the well via pressure control equipment including a blow-out preventor suitable for being hermetically sealed around each of said cylindrical couplings. The method comprises the steps of:

inserting at least some of said sections by means of a first cable of small diameter, e.g., 2 mm to 3 mm, so as to ensure that the weight of the first of said sections is sufficient to overcome the pressure in the well head; and replacing said first cable by a second cable of larger diameter, e.g., 4 mm to 6 mm, after the weight of the inserted sections has exceeded a predetermined value which is a function of the diameter of said second cable.

Figure 1B:
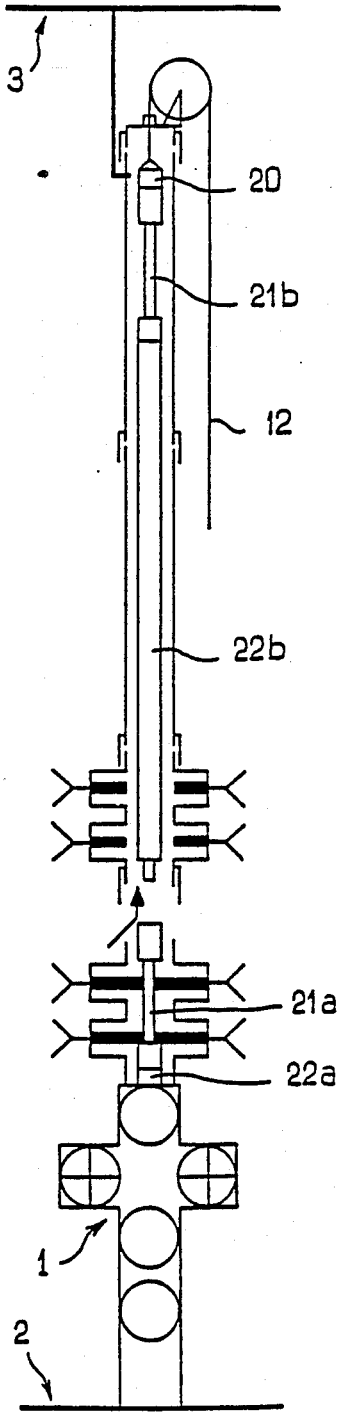
Figure 1C:
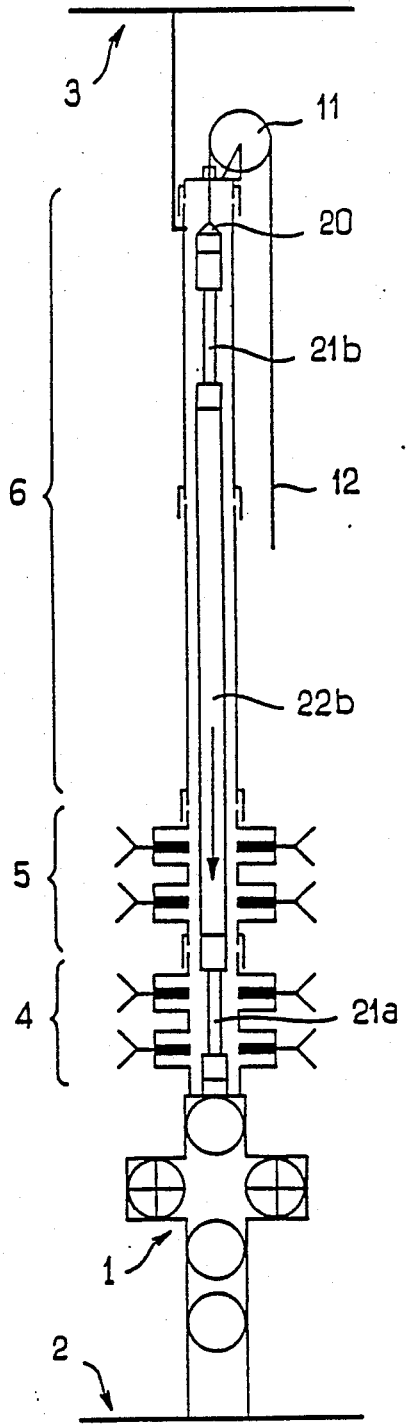
Figure 1D:
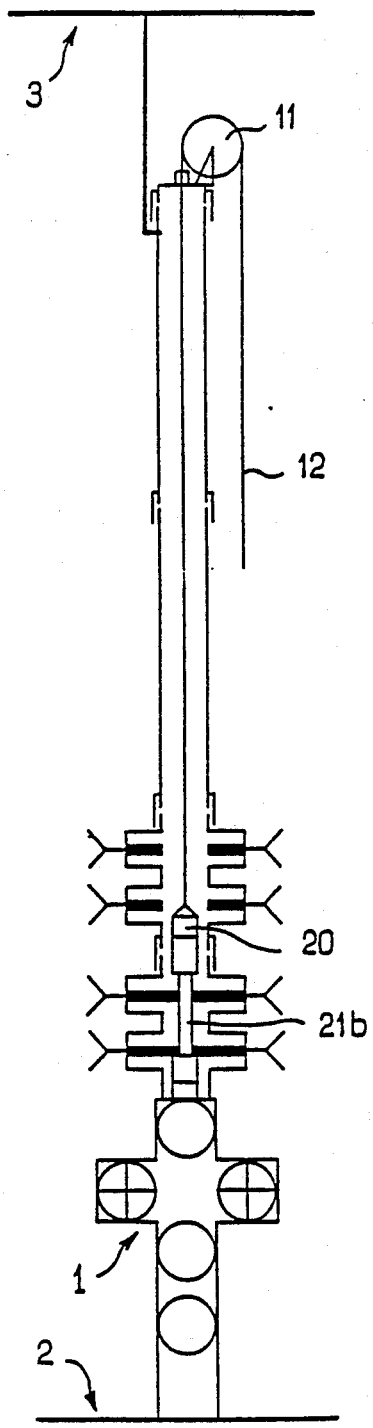
Figure 1E:
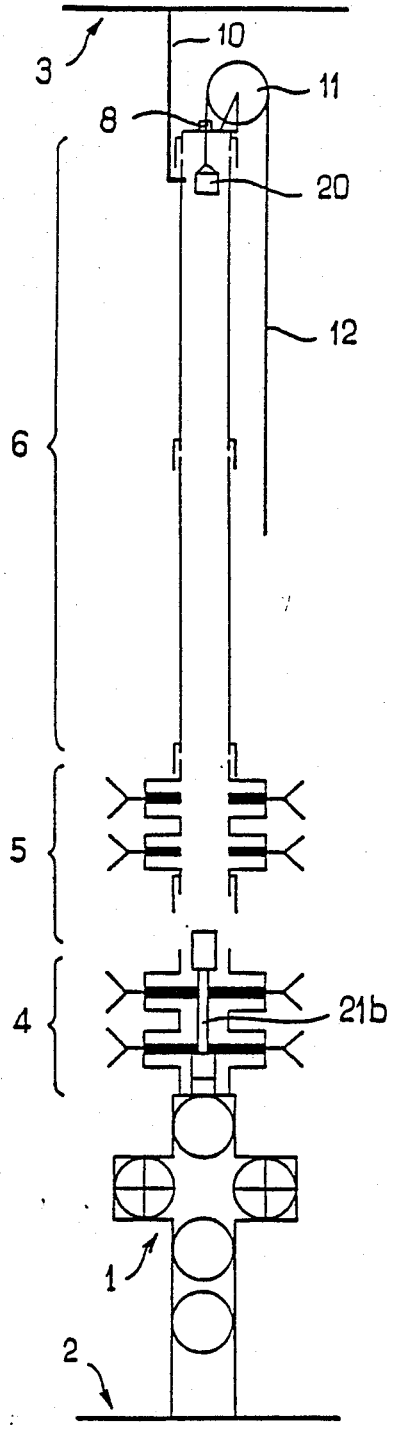
Figure 1F:
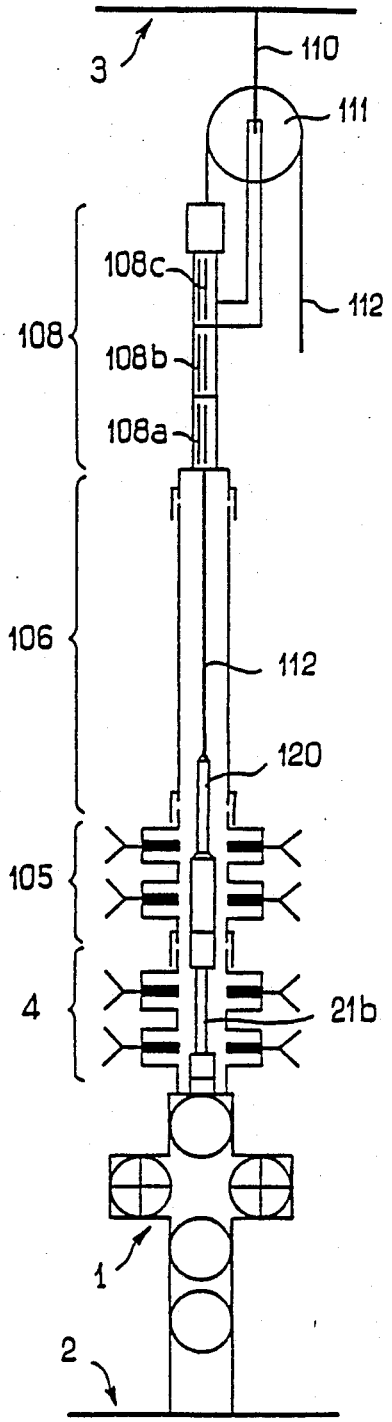
Figure 2:
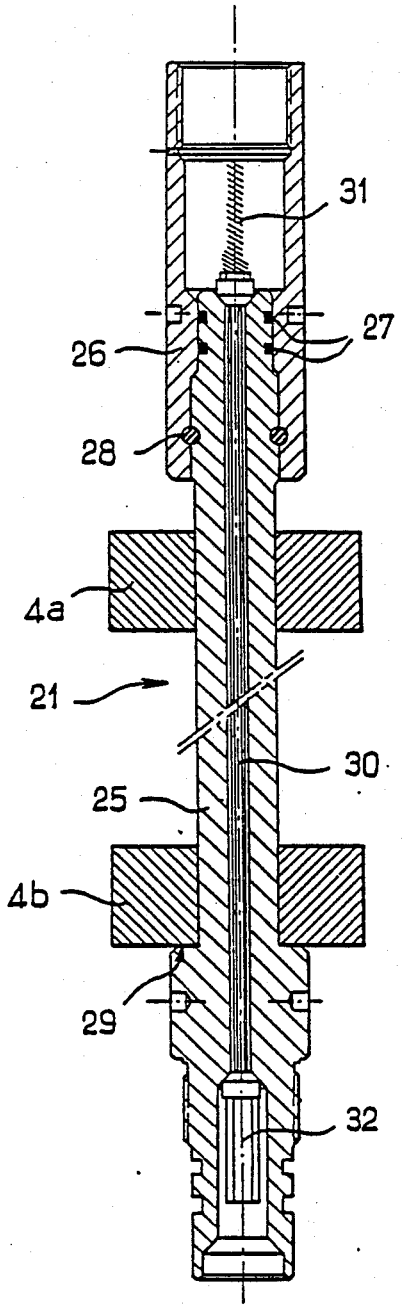

The invention will be better understood from the following detailed description in which:

FIGS. 1A to 1F are diagrams showing successive steps in the method of the invention; and FIG. 2 is a longitudinal section through a particular embodiment of the cylindrical coupling.

With reference to FIGS. 1A and 1B, the well (not shown) is surmounted by a well head 1 also known as a "Christmas tree" because of the typical T-shaped appearance of the valves 1*a*, 1*b*, 1*c*, and 1*d*. The well head 1 emerges through the bottom deck 2 of an off-shore platform (not shown). Vertically above the well head 1, there is the top deck 3 of the platform which prevents a pressure lock being erected to a height sufficient to enable the tool to be inserted into the well in a single operation.

The tool is in the form of an elongate body comprising a plurality of sections 22*a*, 22*b*, . . . , which are assembled end-to-end by means of cylindrical couplings 21*a*, 21*b*, . . . (also known as "slick joints"), and the tool as a whole is suspended from the end of a cable 12 by means of a cable head 20.

Going up from the bottom, the pressure control equipment is essentially constituted, by the following items which are screwed together end-to-end by means of nuts 7*a*, 7*b*, 7*c*, and 7*d*:

a blow-out preventor 4 installed on the well head 1 and provided with jaws 4*a* and 4*b* suitable for being hermetically closed around the cylindrical couplings 21*a*, 21*b*, . . . ;

a blow-out preventor 5 provided with jaws 5*a* and 5*b* suitable for being hermetically closed around the cable 12;

a high pressure tubular column 6 (also known as a "riser") made up of a plurality of tubular sections 6*a*, 6*b*, . . . , disposed end-to-end above the blow-out preventor 5 and constituting the insertion pressure lock; and a sealing device 8 placed at the top of the tubular column 6 around the cable 12 and serving to contain the well pressure during displacement of the cable 12.

At the top of the pressure control equipment, there is a sheave 11 enabling the cable 12 to be guided through the sealing device 8. The assembly constituted by the pressure equipment 4, 5, 6, and 8 and the sheave 11 is suspended from a support 10 suitable for holding the pressure equipment in a vertical position. In the example described, the support 10 is fixed to the top deck 3.

In order to insert the tool into the well, it is necessary for the weight suspended from the end of the cable 12 to be sufficient in comparison with the diameter of the cable 12. The value of the weight required at the end of the cable 12 can be determined approximately by multiplying the pressure in the well head by the cross-sectional area of the cable; however, this approximation does not take account of friction between the cable and the sealing device at the top of the pressure lock.

Some tools, in particular production logging tools, require the use of an electric cable in order to interchange data between the downhole tool and the control and data acquisition system at the surface. Such as electric cable typically has a diameter of about 5.5 mm. Consequently, for a well head pressure of 350 bars associated with a 5.5 mm diameter cable, it is necessary to have a weight of at least 85 kg at the end of the cable; this condition is difficult to satisfy when the pressure lock is not very tall.

In accordance with the invention, a first, small-diameter cable is used for inserting the tool into the well. Since this cable does not require an electrical conductor, it is possible to use a cable whose diameter is 2.3 mm, for example. Preferably, a smooth cable (also known as a "piano wire") is used since it has the further advantage of minimizing friction between the cable and the sealing device. Consequently, a first section having a weight of around 15 kg to 20 kg is sufficient.

The method of inserting the tool in the well is now described in detail with reference to FIGS. 1A to 1E:

(a) the first section 22*a* of the tool is inserted into the well in conventional manner until the cylindrical coupling 21*a* comes level with the jaws 4*a* and 4*b* of the BOP 4;

(b) the jaws 4*a* and 4*b* of the BOP 4 are closed hermetically around the cylindrical coupling 21*a* so as to isolate the pressure lock from the well (FIG. 1A);

(c) the lock 5, 6 is depressurized, emptied, and opened to atmospheric pressure;

(d) the cable head 20 is detached from the cylindrical coupling 21*a*, thereby leaving just the top end of the cylindrical connector 21*a* at atmospheric pressure;

(e) a second section 22*b* connected to the cable head 20 by a second cylindrical coupling 21*b* is inserted into the pressure lock 5, 6 (FIG. 1B);

(f) the second section 22*b* is connected to the first cylindrical coupling 21a;

(g) the pressure lock 5, 6 is hermetically attached to the BOP 4, pressures are equalized, and the jaws 4*a* and 4*b* are opened (FIG. 1C);

(h) tool section 22*b* is inserted into the well until the second cylindrical coupling 21*b* comes level with the jaws 4*a* and 4*b* of the BOP 4; and (i) the jaws 4*a* and 4*b* are closed hermetically around the second cylindrical coupling 21*b* so as to isolate the pressure lock from the well (FIG. 1D).

Steps (c) to (i) are repeated as often as necessary in order to insert the tool into the well (FIG. 1E).

When all of the sections 22*a*, 22*b*, . . . , of the tool have been inserted into the well, or when the total weight of the sections which have been inserted is sufficient to overcome the pressure in the well in conjunction with the cable required for the downhole operation, then the cable 12 can be replaced by a cable 112 of larger diameter (e.g. 5.5 mm) which is fitted at its end with a cable head 120 suitable for connecting to the last cylindrical coupling 21*b* (FIG. 1F).

A quick and simple way of performing this changeover consists in replacing the entire assembly constituted by the BOP 5, the column 6, the seal 8, the support 10, and the sheave 11, with a new assembly constituted by a BOP 105, a column 106, a seal 108, a support 110; and a sheave 111.

The BOP 105 is fitted with jaws 105*a* and 105*b* suitable for closing hermetically on the cable 112. Alternatively, it is possible, right from the beginning of the operation, to use a BOP 5 fitted both with a first set of jaws suitable for closing hermetically around the cable 12 and with a second set of jaws suitable for closing hermetically around the cable 112. However, it may be observed that the BOPs 5 and 105 play no active part in the above-described method; they are provided solely for safety reasons.

The seal 108 is of conventional type with grease being injected through tubes 108*a*, 108*b*, and 108*c*.

Finally, opening the jaws 4*a* and 4*b* allows the tool to be lowered to the desired depth.

When the downhole action has been completed and it is desired to extract the tool from thw well, the method is performed in reverse order.

FIG. 2 shows a particular embodiment of the cylindrical coupling 21. The coupling comprises a cylindrical body 25 which is hermetically received in a sleeve 26 by means of sealing rings 27 and which is rotatably mounted relative to the sleeve 26 by means of a ball bearing 28. The advantage of such a bearing lies in the possibility of screwing the sections 22*a* and 22*b* together end-to-end without twisting the cable 12 or 112.

Further, the cylindrical body has a bearing surface 29 suitable for bearing against the jaw 4*a*, thereby locking the tool in position under the effect of the pressure in the well. It is preferable to use a cylindrical coupling of small diameter in order to reduce as much as possible the effect of the pressure in the well.

The cylindrical body 25 has a bore suitable for passing one or more electrical conductors 30 connecting the connector 30 to the connector 31.

What is claimed is:

1. A method of inserting a tool into a well under pressure, the tool to be suspended from the end of a cable having a given diameter and comprises a plurality of sections interconnected end-to-end by cylindrical couplings, said method comprising the steps of:

sequentially inserting each of said sections into the well via pressure control equipment including a blow-out preventor suitable for being hermetically sealed around each of said sections and said cable, inserting at least some of said sections by means of a first cable having a diameter smaller than said given diameter so as to ensure that the weight of said sections is sufficient to overcome the pressure in the well head; and interconnecting said inserted sections with said previously inserted sections, replacing said first cable by a second cable having said given diameter after the weight of said interconnected sections has exceeded a predetermined value.

2. A method according to claim 1, wherein said first cable has mechanical characteristics which are different from the mechanical characteristics of said second cable.

3. A method according to claims 1 or 2, wherein said second cable includes at least one electrical conductor for establishing electrical communication between said sections and the earth's surface.

4. A method according to claim 1, wherein each of said cylindrical couplings includes a rotary seal.

5. A method according to claims 1 or 2, wherein the diameter of said first cable lies within the range 2 mm to 3 mm.

6. A method according to either of claims 1 or 2, wherein the diameter of said second cable lies within the range 4 mm to 6 mm.

7. A method according to either of claims 1 or 2, wherein the cylindrical coupling has a bearing surface suitable for sealing abutment against interior surfaces of said blow-out preventor.

8. A method according to claim 2, wherein said first cable is a smooth wire.

* * * * *